299-13 SR
11/2/82 XR 4,357,051

United States Patent [19]

Siegel

[11] 4,357,051

[45] Nov. 2, 1982

[54] WITHDRAWAL OF GASES AND LIQUIDS FROM AN IN SITU OIL SHALE RETORT

[75] Inventor: Martin M. Siegel, Broken Arrow, Okla.

[73] Assignee: Occidental Oil Shale, Inc., Grand Junction, Colo.

[21] Appl. No.: 155,411

[22] Filed: Jun. 2, 1980

[51] Int. Cl.[3] ..... E21C 41/10; E21B 43/24

[52] U.S. Cl. ..... 299/2; 299/13

[58] Field of Search ..... 299/2, 13; 166/259

[56] References Cited

U.S. PATENT DOCUMENTS

| | | | |
|---|---|---|---|
| 1,919,636 | 7/1933 | Karrick | 299/2 |
| 2,481,051 | 9/1949 | Uren | 299/2 |
| 3,001,776 | 9/1961 | Van Poollen | 299/2 |
| 4,043,595 | 8/1977 | French | 299/2 |
| 4,143,917 | 3/1979 | Sweany | 299/2 |
| 4,192,553 | 3/1980 | Studebaker et al. | 299/2 |
| 4,263,969 | 4/1981 | Ginsburgh | 166/251 |
| 4,269,449 | 5/1981 | del Rio | 299/2 |

*Primary Examiner*—Ernest R. Purser
*Attorney, Agent, or Firm*—Christie, Parker & Hale

[57] ABSTRACT

An in situ oil shale retort is formed within a subterranean formation containing oil shale. The retort contains a fragmented permeable mass of formation particles containing oil shale. A production level drift extends below the fragmented mass, leaving a lower sill pillar of unfragmented formation between the production level drift and the fragmented mass. During retorting operations, liquid and gaseous products are recovered from a lower portion of the fragmented mass. A liquid outlet line extends from a lower portion of the fragmented mass through the lower sill pillar for conducting liquid products to a sump in the production level drift. Gaseous products are withdrawn from the fragmented mass through a plurality of gas outlet lines distributed across a horizontal cross-section of a lower portion of the fragmented mass. The gas outlet lines extend from the fragmented mass through the lower sill pillar and into the production level drift. The gas outlet lines are connected to a gas withdrawal manifold in the production level drift, and gaseous products are withdrawn from the manifold separately from withdrawal of liquid products from the sump in the production level drift.

46 Claims, 8 Drawing Figures

WITHDRAWAL OF GASES AND LIQUIDS FROM AN IN SITU OIL SHALE RETORT

BACKGROUND

This invention relates to withdrawal of liquid and gaseous products of retorting from an in situ oil shale retort.

The presence of large deposits of oil shale in the Rocky Mountain region of the United States has given rise to extensive efforts to develop methods for recovering shale oil from kerogen in the oil shale deposits. It should be noted that the term "oil shale" as used in the industry is in fact a misnomer; it is neither shale, nor does it contain oil. It is a sedimentary formation comprising marlstone deposit with layers containing an organic polymer called "kerogen", which upon heating decomposes to produce liquid and gaseous products. It is the formation containing kerogen that is called "oil shale" herein, and the liquid hydrocarbon product is called "shale oil".

A number of methods have been proposed for processing oil shale which involve either first mining the kerogen-bearing shale and processing the shale on the ground surface, or processing the shale in situ. The latter approach is preferable from the standpoint of environmental impact, since the treated shale remains in place, reducing the chance of surface contamination and the requirement for disposal of solid wastes.

The recovery of liquid and gaseous products from oil shale deposits have been described in several patents, such as U.S. Pat. Nos. 3,661,423; 4,043,595; 4,043,596; 4,043,597 and 4,043,598 which are incorporated herein by this reference. These patents describe in situ recovery of liquid and gaseous hydrocarbon materials from a subterranean formation containing oil shale, wherein such formation is explosively expanded for forming a stationary, fragmented permeable mass of formation particles containing oil shale within the formation, referred to herein as an in situ oil shale retort. Retorting gases are passed through the fragmented mass to convert kerogen contained in the oil shale to liquid and gaseous products, thereby producing retorted oil shale. One method of supplying hot retorting gases used for converting kerogen contained in the oil shale, as described in U.S. Pat. No. 3,661,423, includes establishing a combustion zone in the retort and introducing an oxygen-supplying retort inlet mixture into the retort to advance the combustion zone through the fragmented mass. In the combustion zone, oxygen from the retort inlet mixture is depleted by reaction with hot carbonaceous materials to produce heat, combustion gas, and combusted oil shale. By the continued introduction of the retort inlet mixture into the fragmented mass, the combustion zone is advanced through the fragmented mass in the retort.

The combustion gas and the portion of the retort inlet mixture that does not take part in the combustion process pass through the fragmented mass on the advancing side of the combustion zone to heat the oil shale in a retorting zone to a temperature sufficient to produce kerogen decomposition, called "retorting." Such decomposition in the oil shale produces gaseous and liquid products, including gaseous and liquid hydrocarbon products, and a residual solid carbonaceous material.

The liquid products and the gaseous products are cooled by the cooler oil shale fragments in the retort on the advancing side of the retorting zone. The liquid hydrocarbon products, together with water produced in or added to the retort, collect at the bottom of the retort and are withdrawn. An off gas is also withdrawn from the bottom of the retort. Such off gas can include carbon dioxide generated in the combustion zone, gaseous products produced in the retorting zone, carbon dioxide from carbonate decomposition, and any gaseous retort inlet mixture that does not take part in the combustion process. The products of retorting are referred to herein as liquid and gaseous products.

It is desirable that oxygen-supplying gas flow relatively uniformly through a fragmented mass during retorting operations. Gas channeling through the fragmented mass can occur if there is non-uniform permeability in horizontal planes across the fragmented mass. By producing a generally uniform flow of gas across the horizontal cross-section of the fragmented mass during retorting, bypassing portions of the fragmented mass by retorting gas can be reasonably avoided, producing a reasonably uniform conversion of kerogen to liquid and gaseous products during retorting. Such a uniform conversion of kerogen to liquid and gaseous products can increase product yield from the fragmented mass when compared with a retort in which gas flow is not reasonably uniform.

Gaseous products of retorting in an in situ oil shale retort can include a process off gas that contains nitrogen, hydrogen, carbon monoxide, carbon dioxide, water, vapor, methane, and other hydrocarbons and sulfur compounds, such as hydrogen sulfide. Hydrogen sulfide and carbon monoxide are extremely toxic gases. For this reason, such off gases have been withdrawn from the fragmented mass through a gas withdrawal drift that is sealed against the passage of off gas from the portion of the drift where the off gas collects, so that workers in adjacent underground workings are isolated from the off gas. Such a gas withdrawal drift is commonly sealed with a bulkhead placed across the drift. Such a bulkhead can comprise a steel bulkhead plate secured to a rigid framework, with concrete anchoring the peripheral portion of the bulkhead to provide a substantially gas-tight seal across the drift.

In other methods for withdrawing liquid and gaseous products of retorting from a fragmented mass, a substantial constriction can be created in the horizontal cross-sectional area through which gas can flow between the upper regions of the fragmented mass and a production level drift. Such a constriction to gas flow can increase gas velocities in the lower portion of the fragmented mass to as high as five to ten times the velocity of gas flow in the upper elevations of the fragmented mass. Such a high velocity can entrain fine droplets of shale oil in the gas flowing through the lower portion of the fragmented mass, producing aerosols which are withdrawn in the retort stack gas. To maximize the product yield of the retort, it is desirable to minimize the amount of shale oil withdrawn as an aerosol in the retort stack gas.

The present invention provides techniques for withdrawing liquid and gaseous products of retorting from a lower portion of a fragmented mass such that the need for a conventional gas-tight bulkhead sealed across a production level drift can be eliminated. The invention thus can reduce the time and cost required in forming a gas seal in a production level drift because of materials cost and labor for constructing a conventional bulkhead structure can be avoided. The present invention also avoids the chance of gas leakage through such a bulkhead, and gas leakage through formation around such a bulkhead also is alleviated.

The present invention also can minimize the amount of shale oil withdrawn as an aerosol in the retort stack gas, as well as providing means for reasonably controlling the uniformity of the gas flow profile through the fragmented mass during retorting.

Some in situ oil shale retorts have a gas outlet at one side of the bottom of the fragmented mass and non-uniform gas flow can be encountered. It is desirable to have distributed gas outlet means at the bottom of an in situ retort for promoting uniform gas flow.

SUMMARY OF THE INVENTION

One embodiment of the present invention provides an in situ oil shale retort formed in a subterranean formation containing oil shale, wherein such an in situ retort contains a fragmented permeable mass of formation particles containing oil shale. A retorting zone established in the fragmented mass and advanced downwardly through the fragmented mass produces liquid and gaseous products of retorting. A production level void is spaced below the fragmented mass, leaving a lower sill pillar of unfragmented formation for providing a gas barrier between a lower portion of the fragmented mass and the production level void. At least one liquid outlet line extends from a lower portion of the fragmented mass through the lower sill pillar into the production level void, and at least one gas outlet line extends from a lower portion of the fragmented mass through the lower sill pillar into the production level void. Liquid products are conducted from the fragmented mass to the production level void through such a liquid outlet line and such liquid products are withdrawn from the production level void. Gaseous products are conducted from the fragmented mass to the production level void through such a gas outlet line, and such gaseous products are withdrawn from the production level void separately from withdrawal of liquid products from the production level void.

If desired, the flow of gas through a horizontal cross-section of the fragmented mass can be controlled from within the production level void by selectively adjusting the flow of gas through separate gas outlet lines distributed across the horizontal cross-section of the fragmented mass and extending from the fragmented mass to the production level.

A liquid/gas separator can be provided on an inlet end of such a gas outlet line for inhibiting flow of liquid products into such a gas outlet line for separating liquid from gas flowing into such a gas outlet line through the liquid/gas separator.

DRAWINGS

These and other aspects of the invention will be more fully understood by referring to the following detailed description and the accompanying drawings in which.

DETAILED DESCRIPTION

Figure 1:
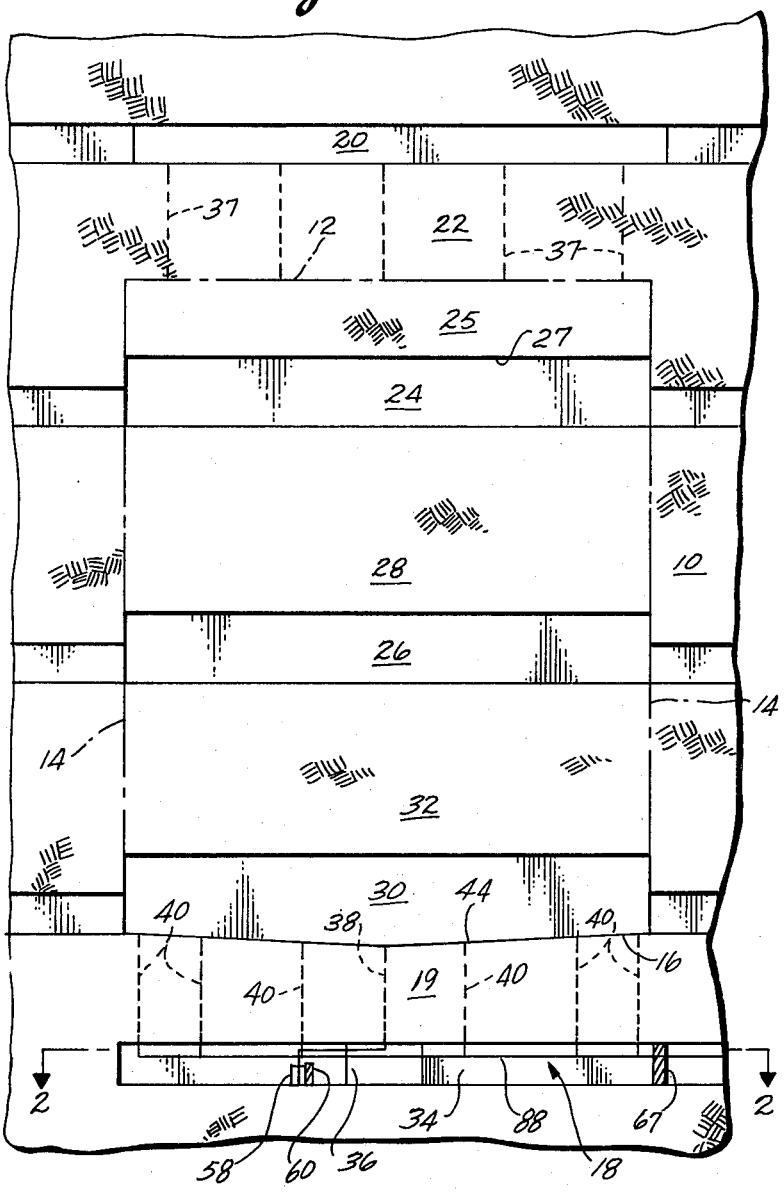
FIG. 1 is a fragmentary, semi-schematic vertical cross-section showing an in situ oil shale retort in an intermediate stage of preparation for withdrawal of gaseous and liquid products of retorting according to principles of this invention.

FIG. 1 is a semi-schematic vertical cross-section illustrating an in situ oil shale retort being formed in accordance with principles of this invention. The retort is being formed in a subterranean formation 10 containing oil shale. The in situ retort is rectangular in horizontal cross-section, having a top boundary 12, four vertically extending side boundaries 14, and a lower boundary 16. A void space 18 at a production level spaced below the lower boundary of the retort site provides a region in which liquid and gaseous products of retorting are recovered during subsequent retorting operations in the in situ retort being formed. The roof of the production level void is spaced below the lower boundary 16 of the retort being formed, leaving a horizontal lower sill pillar 19 of unfragmented formation between the roof of the production level void and the lower boundary of the retort being formed.

A portion of the formation above the retort site is excavated on an upper working level for forming an open base of operation 20. The floor of the base of operation is spaced above the upper boundary 12 of the retort being formed, leaving a horizontal upper sill pillar 22 of unfragmented formation between the floor of the base of operation and the upper boundary of the retort. A description of a sill pillar is provided in U.S. Pat. No. 4,118,071, which is incorporated herein by this reference.

The horizontal cross-section of the upper base of operation is sufficient to provide effective access to substantially the entire horizontal cross-section of the retort being formed. The upper base of operation provides access for drilling and explosive loading for subsequently explosively expanding formation toward voids formed within the retort site for forming a fragmented permeable mass 23 (see FIG. 7) of formation particles containing oil shale within the upper, side and lower boundaries 12, 14, 16 of the retort being formed. The base of operation also facilitates introducing oxygen-supplying gas into the top of the fragmented mass formed below the upper sill pillar 22, and for this reason, the base of operation can be referred to as an air level void. One or more pillars (not shown) of unfragmented formation can be left within the upper level void for providing roof support for overburden overlying the upper base of operation.

The in situ retort illustrated in FIG. 1 comprises a horizontal free face system in which formation is excavated from within the retort site for forming a plurality of vertically spaced spart retort level voids each extending horizontally across a different level of the retort site, leaving zones of unfragmented formation within the retort site adjacent pairs of horizontal voids. In the illustrated horizontal free face system, three vertically spaced apart horizontal retort level voids are excavated within the retort site below the upper sill pillar 22. A rectangular upper void 24 is excavated at a level spaced below the upper sill pillar, leaving an upper zone 25 of unfragmented formation extending horizontally across the retort site between the upper boundary of the retort being formed and a horizontal upper free face 27 of unfragmented formation above the upper void. A rectangular intermediate void 26 is excavated at an intermediate level of the retort being formed, leaving an intermediate zone 28 of unfragmented formation extending horizontally across the retort site between a horizontal lower free face below the upper void and a horizontal upper free face above the intermediate void. A rectangular lower void 30 is excavated at a lower level of the retort being formed, leaving a lower zone 32 of unfragmented formation extending horizontally across the retort site between a horizontal lower free face below the intermediate void and a horizontal upper free face above the lower void. In the embodiment shown, the upper, intermediate and lower voids all have a similar horizontal cross-sectional area, and the three voids are excavated directly above one another, with their outer boundaries being in common vertical planes. One or more pillars (not shown) of unfragmented formation are left within each of the horizontal voids for providing temporary roof support for the zone of unfragmented formation overlying each void.

The upper, intermediate and lower voids preferably occupy from about 15% to about 25% of the total volume of formation within the retort being formed. In a working embodiment, the vertical distance between the upper boundary and the lower boundary of the fragmented mass being formed is about 270 feet. The height of the upper, intermediate and lower voids is about 35 feet each. The height of the upper zone 25 of unfragmented formation is about 35 feet, and the thickness of the intermediate and lower zones of unfragmented formation is about 70 feet. The upper, intermediate and lower voids are each about 160 feet wide and 160 feet long. The height of the upper sill pillar is about 50 feet, and the height of the upper base of operation is about 20 feet. The height of the lower sill pillar is about 45 feet and the height of the production level drift is about 25 feet.

Figure 2:
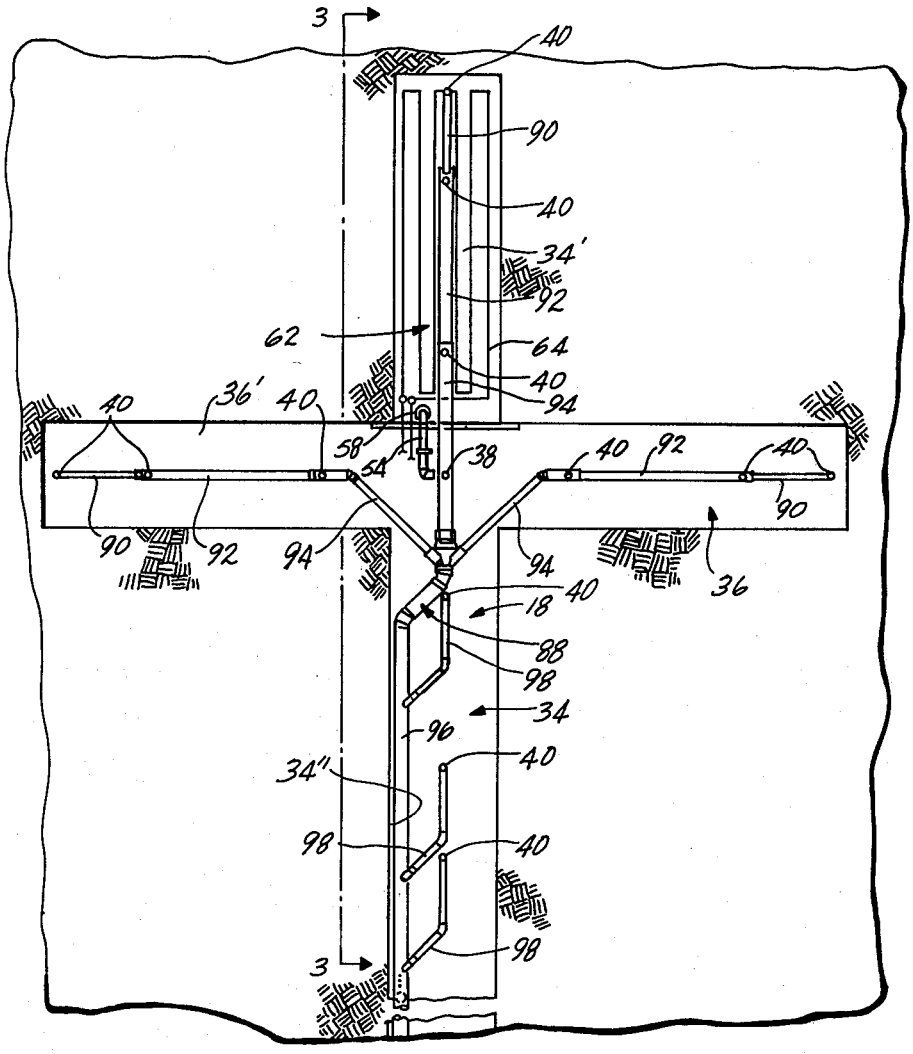
FIG. 2 is a fragmentary, semi-schematic horizontal cross-section taken on line 2—2 of FIG. 1.

Following excavation of the upper, intermediate, lower, and production level voids 24, 26, 30, 18, the retort site is prepared for recovery of liquid and gaseous products produced during subsequent retorting operations in the fragmented mass 23 being formed. As best illustrated in FIG. 2, the production level void 18 comprises a pair of long, narrow, straight production level drifts that intersect one another at a right angle near the center of the retort forming a generally cross-shaped production level void when the void is viewed in the plan view of FIG. 2. The production level void includes a main production level drift 34 (shown in its entire length in FIG. 3 as well as in FIG. 2) extending horizontally across substantially the entire width of the retort being formed, and a production level cross drift 36 intersecting the main drift and extending horizontally across substantially the entire length of the retort being formed. The production level cross drift comprises a pair of stub cross drifts 36' extending away from opposite sides of the main production level drift. Each stub cross drift terminates approximately below a corresponding side boundary 14 of the retort being formed. The main production level drift includes a main stub drift 34' extending away from one side of the cross drift to an end approximately below a side boundary 14 of the retort being formed. The main production level drift also includes a main open drift 34" extending away from an opposite side of the cross drift from the main stub drift. The main open drift extends beyond a corresponding side boundary of the retort being formed and is open to other underground workings on the production level. The cross-shaped production level void can be considered to have four legs extending outwardly 90° apart from one another.

FIG. 1 schematically illustrates a vertical liquid outlet line 38 and a plurality of horizontally spaced apart vertical gas outlet lines or passages 40 extending from the lower level void 30 through the sill pillar 19 and into the production level void. These passages are used during subsequent retorting operations for withdrawing liquid and gaseous products of retorting from a lower portion of the fragmented mass 23 being formed.

The fragmented mass is formed by placing explosive charges (not shown) in the upper, intermediate and lower zones of unfragmented formation and detonating the explosive charges for explosively expanding the unfragmented zones toward the horizontal free faces of formation adjacent the voids for forming a fragmented permeable mass of formation particles containing oil shale in an in situ oil shale retort. Explosive charges also are placed in pillars within the upper, intermediate and lower voids, and the explosive charges in the pillars are preferably detonated a short time interval before explosive in the zones of unfragmented formation is detonated for explosively expanding the pillars. The void volume initially present in the upper, intermediate and lower voids becomes interspersed throughout formation particles in the fragmented mass following explosive expansion.

After forming the fragmented mass, the final preparation steps for producing liquid and gaseous products are carried out. These include introducing an oxygen-supplying gas into the fragmented mass through a plurality of feed gas inlet passages 37 (see FIG. 1) drilled downwardly from the upper base of operation to the top boundary of the fragmented mass. During retorting operations, a combustion zone is established in the fragmented mass, and the combustion zone is advanced downwardly through the fragmented mass by introducing an oxygen-supplying gas into the fragmented mass. Combustion gas produced in the combustion zone passes through the fragmented mass to establish a retorting zone on the advancing side of the combustion zone, wherein kerogen in the oil shale is retorted to produce liquid and gaseous products of retorting. The liquid products and the off gas containing gaseous products pass to the bottom of the fragmented mass and are recovered in the production level void 18 by passing through the separate liquid and gas outlet lines 38, 40 extending from the fragmented mass through the lower sill pillar into the production level void. The liquid and gaseous products are separately withdrawn from the production level void.

The liquid outlet line 38 is provided by a vertical bore hole 42 drilled downwardly from a floor 44 of the lower horizontal void through the lower sill pillar and through the roof in the production level void. The bore hole preferably is located in the center of the floor of the lower void. In one embodiment, the floor of the lower void slopes downwardly toward the inlet end of the bore hole so that the inlet is at the lowest elevation of the floor. Liquid products of retorting produced throughout the horizontal cross-section of the fragmented mass thus can drain under gravity across the sloping floor toward the inlet end of the bore hole. In the illustrated embodiment, one liquid outlet line is shown although a plurality of such liquid outlet lines distributed across the floor of the lower void can be used if desired. The liquid outlet line includes a grating 46 placed over the inlet end of the bore hole to prevent fragmented formation particles from entering the liquid outlet line. The grating is welded to the top of an annular plate 47 surrounding the inlet end of the bore hole and overlying the floor of the lower void. The grating is of sufficient structural strength to withstand the blast effects from explosive expansion when forming the fragmented mass. If desired fragmented formation can be piled over the grate before explosive expansion to buffer blast effects. Rock bolts 48 secure the plate to formation surrounding the inlet end of the bore hole. In a preferred embodiment, the bore hole forming the liquid outlet line is a 15-inch diameter hole, with a 12-inch diameter tubular upper casing 49 placed in the upper portion of the bore hole and cemented in place by grout 50. The upper casing preferably extends through most of the depth of the lower sill pillar, terminating approximately one foot above the upper end of a 12-inch diameter lower tubular casing 52 in the lower ten feet of the bore hole. The liquid outlet line is cased to prevent liquid soaking and subsequent sloughing of the hole wall. Thermal expansion inhibits use of a continuous casing in bore holes serving as liquid outlet and gas outlet lines.

Figure 3:
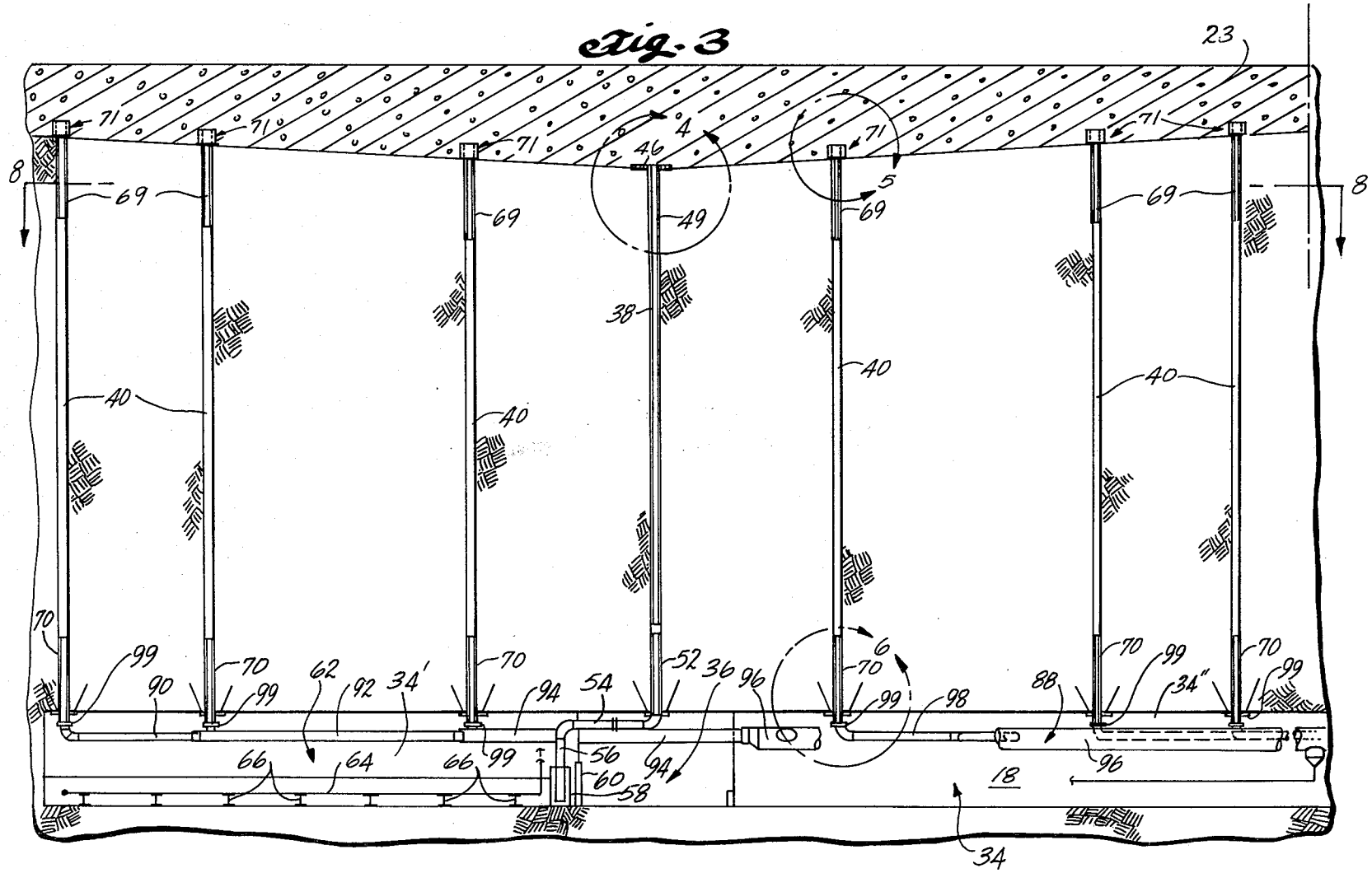
FIG. 3 is a fragmentary, semi-schematic vertical cross-section taken on line 3—3 of FIG. 2.
Figure 4:
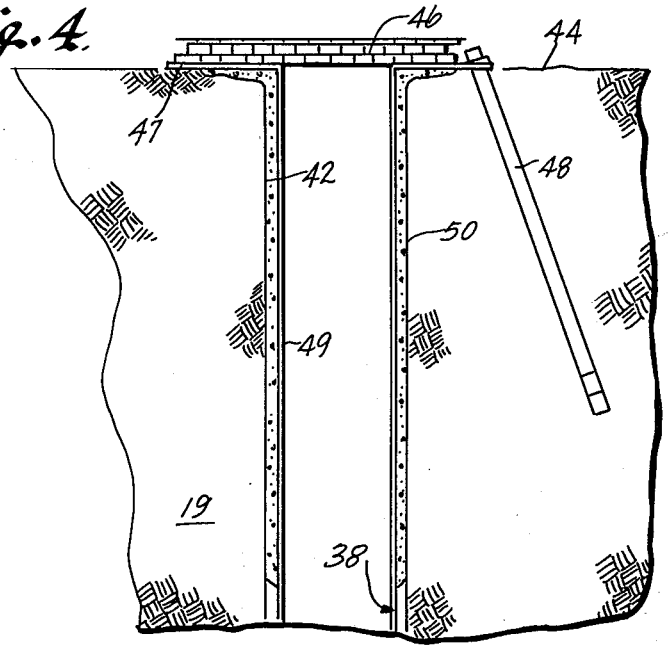
FIG. 4 is a fragmentary vertical cross-section showing an enlarged view of a liquid outlet shown within the circle 4 of FIG. 3.

Referring to FIG. 3, a drainage conduit 54 in the production level void 18 extends from the lower end of the lower casing 52 in the liquid outlet line to a vertical conduit 56 which terminates inside an open topped drainage tank 58 in the production level void. The drainage tank is initially filled with water to form a gas seal to prevent entry of off gas from the fragmented mass to the production level void. The drainage tank is placed behind a sump bulkhead 60 near the entrance to the main stub drift 34' of the production level void. The sump bulkhead 60 extends across the entire width of the main stub drift to provide a dam for liquid products draining into a sump 62 provided by the main stub drift behind the bulkhead. Once retorting operations begin, liquid products flowing to the lower portion of the fragmented mass are directed toward the liquid outlet line. That is, liquid drains under gravity across the sloping floor 44 below the fragmented mass and through the liquid outlet line. Liquid accumulating in the drainage tank in the production level void causes the tank to overflow into the sump formed behind the sump bulkhead. The sump can include heating coils 64 which preferably circulate hot water or steam for reducing the viscosity of liquid products draining into the sump and helping separate emulsions of shale oil and water. The heating coils can be supported above the floor of the sump by supports 66. In one embodiment, the sump can contain approximately 800 barrels of liquid behind the sump bulkhead 60. In the illustrated embodiment, the sump bulkhead extends upwardly for approximately half the height of the production level void, and liquid can be allowed to overflow the sump bulkhead and collect in the main portion 34'' of the production level drift, as illustrated schematically in FIG. 7. A main production level bulkhead 67 (see FIGS. 1 and 7) can enclose the portion 34'' of the production level drift which is open to adjacent underground workings, and liquid overflowing the sump bulkhead can be contained within the production level drift by the main bulkhead. The sump bulkhead and the main bulkhead need not be structural bulkheads in the sense that they are not exposed to the high temperatures in the lower portion of a fragmented mass during retorting operations, and these bulkheads need not be gas-tight for the purpose of sealing against flow of off gas from one side of the bulkhead to the other. In one embodiment, the sump bulkhead is a concrete wall, and the main bulkhead has a lower portion made of concrete and an upper portion made of light gauge metal.

The gas outlet lines 40 are distributed across the horizontal cross-section of the lower portion of the fragmented mass. A plurality of gas outlet lines extend from the lower portion of the fragmented mass through the lower sill pillar into each leg of the production level void. The lower sill pillar provides a gas barrier between the fragmented mass and the production level void. Preferably, the same number of gas outlet lines extend into each leg of the production level void, so that the gas outlet lines are symmetrically distributed across the bottom of the fragmented mass. In the illustrated embodiment there are twelve gas outlet lines, with three of such gas outlet lines extending vertically from the floor of the lower horizontal void into each leg of the production level void. The three conduits in each leg of the production level void are mutually spaced apart along the length of the drift, and the spacing distance between conduits in each leg of the drift is preferably the same as the spacing distance between conduits in the other legs of the drift. In the illustrated embodiment, the gas outlet lines comprise 15-inch diameter bore holes 68 drilled from the floor of the lower void through the lower sill pillar and through the roof of the production level drift. A separate 12-inch diameter tubular upper casing 69 extends approximately the upper ten feet of each bore hole, and a separate 12-inch diameter tubular lower casing 70 extends for approximately the lower ten feet of each bore hole. The upper and lower casings are sealed to unfragmented formation within the lower sill pillar to inhibit passage of gas from the fragmented mass to the production level void independently of passage of such gas through the gas outlet lines. Appreciably larger or a greater number of gas outlet lines can be used, if desired, for increasing the cross-sectional area for gas flow through the gas outlet lines.

It is desirable that placement of the gas outlet lines 40 be such that the amount of formation particles within the fragmented mass above each gas outlet be approximately equal. By spacing the gas outlet lines across the floor of the fragmented mass so as to approximately equalize the amount of formation particles above each outlet, gas flow rates can be reasonably equalized among the gas outlet lines, which, in turn, can facilitate providing a generally uniform flow rate of gas across the horizontal cross-section of the fragmented mass.

Figure 8:
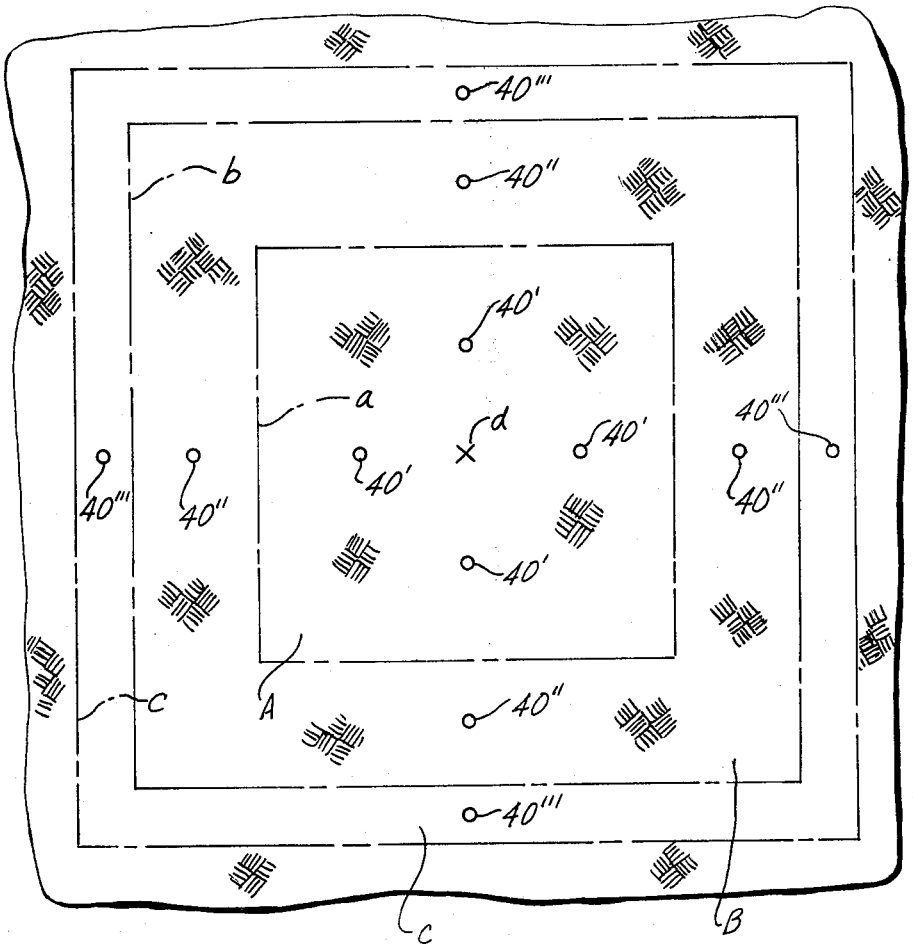
FIG. 8 is a fragmentary, semi-schematic horizontal cross-sectional view taken on line 8—8 of FIG. 3 and showing an arrangement of gas flow passages extending through a gas barrier.

FIG. 8 illustrates one arrangement for placement of the gas flow lines in order to reasonably equalize the amount of formation particles above each gas outlet line. The horizontal cross-section of the fragmented mass is separated into three areas defined by a rectangular outer boundary line "c" that defines the outer boundary of the fragmented mass 23, a rectangular intermediate boundary line "b" spaced inside the outer boundary line, and a rectangular inner boundary line "a" spaced inside the intermediate boundary line. The rectangular inner boundary line "a" has a center "d". The space inside the inner boundary line defines a first area A, the space between lines a and b defines a second area B, and the space between lines b and c defines a third area C. The areas A, B and C are approximately equal to one another. The gas outlet lines are arranged so that an equal number of gas outlet lines are within each enclosed area, and the gas outlet lines within each area are arranged symmetrically within the confines of the area. In the illustrated embodiment, the gas outlet lines within each enclosed area are equidistantly spaced apart around the enclosed area. Each gas line 40''' in area C is equidistantly spaced from the boundary lines c and b on opposite sides of it; each gas line 40'' in area B is equidistantly spaced from the boundary lines b and a on opposite sides of it; and each gas line 40' in area A is equidistantly space from the center d of the retort and the inner boundary line a.

In the illustrated embodiment, in order to equalize the amount of fragmented mass above each gas line, the innermost gas outlet line 40' in each leg of the production level void is spaced longitudinally approximately 23 feet from the liquid outlet line 38; the intermediate gas outlet line 40'' in each leg of the production level void is spaced longitudinally approximately 33 feet from the innermost gas outlet line; and the outermost gas outlet line in each leg of the void is spaced longitudinally approximately 17 feet from the intermediate conduit. The outermost gas outlet line also is spaced horizontally approximately 9 to 10 feet inwardly from the plane defined by the vertical side boundary of the retort being formed.

Figure 5:
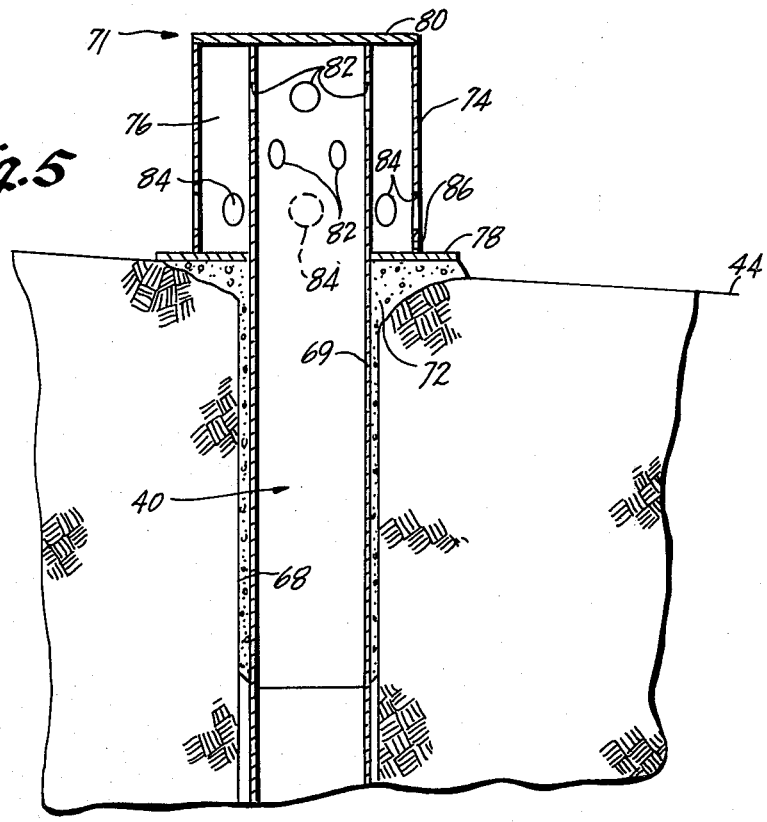
FIG. 5 is a fragmentary vertical cross-section showing an enlarged view of a gas/liquid separator within the circle 5 of FIG. 3.

Separate liquid/gas separation caps 71 are installed above each of the gas outlet lines in a lower portion of the fragmented mass. The liquid/gas separation caps separate gas from liquid within the fragmented mass prior to the separated liquid and gas being separately conducted to the production level void through the liquid and gas outlet lines. The liquid/gas separation caps are similar to one another and their structure is understood best by referring to the cross-sectional view of FIG. 5. Cement grout 72 seals an exterior portion of the upper casing 69 in an upper portion of a bore hole 68 forming a given gas outlet line 40. An upper portion of the tubular casing 69 projects above the floor 44 of the lower horizontal void. Each cap includes an upright outer stub pipe 74 placed concentrically around a projecting portion of the upper casing. In the illustrated embodiment the outer stub pipe is a 24-inch diameter pipe, and therefore the pipe wall of the stub pipe is spaced radially outwardly from the adjacent side wall of the upper casing, forming an annulus 76 inside the outer stub pipe and surrounding the side wall of the upper casing. The annular bottom edge of the outer stub pipe is welded to an annular plate 78 overlying a flat surface formed by the cement grout surrounding the projecting portion of the upper casing. A flat imperforate circular top plate 80 is welded to the annular top edge of the outer stub pipe 74 to cover the top of the annulus 76. The top plate 80 also rests on the top edge of the projecting portion of the inner casing to cover the upper end of the upper casing.

Two vertically spaced apart rows of circumferentially spaced apart inner gas inlet holes 82 extend through the upper portion of the upper casing inside the cap. There are four inner gas inlet holes in an upper row spaced equidistantly apart from one another on 90° centers, and four inner gas inlet holes in a lower row also spaced equidistantly apart on 90° centers. The holes in the lower row are staggered 45° apart from the holes in the upper row. A single row of circumferentially spaced apart outer gas inlet holes 84 extends through a lower portion of the outer stub pipe 74. There are eight lower gas inlet holes equidistantly spaced apart on 45° centers, all on the same horizontal plane around the outer stub pipe. The bottom portions of the inner gas inlet holes 82 are spaced vertically above the upper portions of the outer gas inlet holes 84. Two liquid weep holes 86 are formed in the outer stub pipe immediately above the lower annular plate 78, i.e., below the outer gas inlet holes. The two weep holes are located adjacent one another near the point of lowest elevation of the outer stub pipe. In the illustrated embodiment, the inner gas inlet holes 82 are 3½ inches in diameter, the outer gas inlet holes 84 are 4 inches in diameter, and the two weep holes 86 are 1 inch in diameter. If desired the top plate 80 can be spaced above the top of the inner casing to permit gas passage and the holes through the wall of the casing can be deleted.

During explosive expansion for forming the fragmented mass, the liquid/gas separation caps 71 on the gas outlet lines protect the gas outlet lines from the effects of blasting. Further protection from the effects of blasting can be provided by piling several feet of fragmented formation particles on top of the caps prior to blasting. The annular bottom plates to which the caps are welded not only connect the caps to the upper casings of the gas outlet lines, but they also spread out the downward force of the blast during explosive expansion.

During retorting operations, the liquid/gas separation caps separate liquid and gas within the fragmented mass by inhibiting drainage of liquid products from the fragmented mass into the gas outlet lines and by allowing passage of off gas from the fragmented mass through the interior chamber of each cap and then into the inlet of each gas outlet line. The separation caps cause a change in direction of flow within the interior chamber of the caps prior to gas entering the gas outlet pipes, which produces additional liquid/gas separation. More specifically, the caps seal the top opening in each upper casing 69 from the fragmented mass, so that the only passage open to the fragmented mass in each upper casing is provided by the inner gas inlet holes 82. Since the inner gas inlet holes are at a higher elevation than the outer gas inlet holes 84 in the surrounding cap, flow of liquid through the inner gas inlet holes (and hence to the interior of the gas outlet lines and the production level void) is inhibited by the change in direction of any flow into the inner gas inlet holes required by the relative elevations of the outer and inner gas inlet holes. Liquid products collecting at the bottom of the fragmented mass during retorting thus follow the path of least resistance and drain across the sloping floor at the base of the fragmented mass and drain under gravity through the central liquid outlet line 38. Gaseous products drawn to the bottom of the fragmented mass pass through the outer gas inlet holes in the caps 71 and then through the inner gas inlet holes in the upper casings, and such gaseous products are then drawn downwardly through the gas outlet lines to the production level void. Since the inner gas inlet holes in the upper casings of the gas outlet lines are at an elevation above the outer gas inlet holes in the caps 71, a change in direction is produced in the stream of gas flowing from the fragmented mass through each cap before the gas flows into the inlet to each gas outlet line. This change of direction can cause liquid droplets entrained in the gas to be separated from the gas stream within the lower portion of the fragmented mass, thereby assisting in reducing aerosol entrainment in the off gas removed from the retort. The weep holes in the bottoms of the caps permit drainage of any liquid that either passes inside the caps or is separated from off gas drawn into the caps.

The bottoms of the casings 70 in the lower portions of the gas outlet lines are connected to a common off gas manifold 88 for use in withdrawing gaseous products from the production level void. Portions of the off gas manifold extend horizontally through each of the three stub drifts in the production level void. Each of these portions of the manifold includes an elongated outer pipe 90 connected to the outermost gas outlet line in the stub drift, an elongated intermediate pipe 92 communicating with the end of the outer pipe and connected to the bottom of the intermediate gas outlet line in the stub drift, and an elongated inner pipe 94 communicating with the end of the intermediate pipe and connected to the bottom of the innermost gas outlet line in the stub drift. The outer, intermediate and inner pipes of the manifold in each stub drift are progressively larger in diameter in directions away from the ends of the stub drifts to accommodate the progressively larger volume of off gas withdrawn from the retort in directions away from the ends of the stub drifts. Separate expansion glands (not shown) seal the joints between pipe sections. The three inner pipes 92 extend toward one another near the center of the production level void where they are connected to a common main off gas withdrawal pipe 96 extending horizontally through the main open portion 34'' of the production level void. The main off gas withdrawal pipe 94 is of larger diameter than the three inner pipe sections leading to it. The manifold also includes separate branch tubes 98 connecting the main off gas withdrawal pipe 96 with the bottom portions of the three gas outlet lines extending into the main open portion 34'' of the production level void. The separate branch tubes can be of the same diameter as the outer pipes 90 in each of the stub drifts. In one embodiment, the outer pipes and the branch tubes are 12 inches in diameter, the intermediate pipes are 16 inches in diameter, the inner pipes are 18 inches in diameter, and the main off gas withdrawal pipe is 36 inches in diameter.

Figure 6:
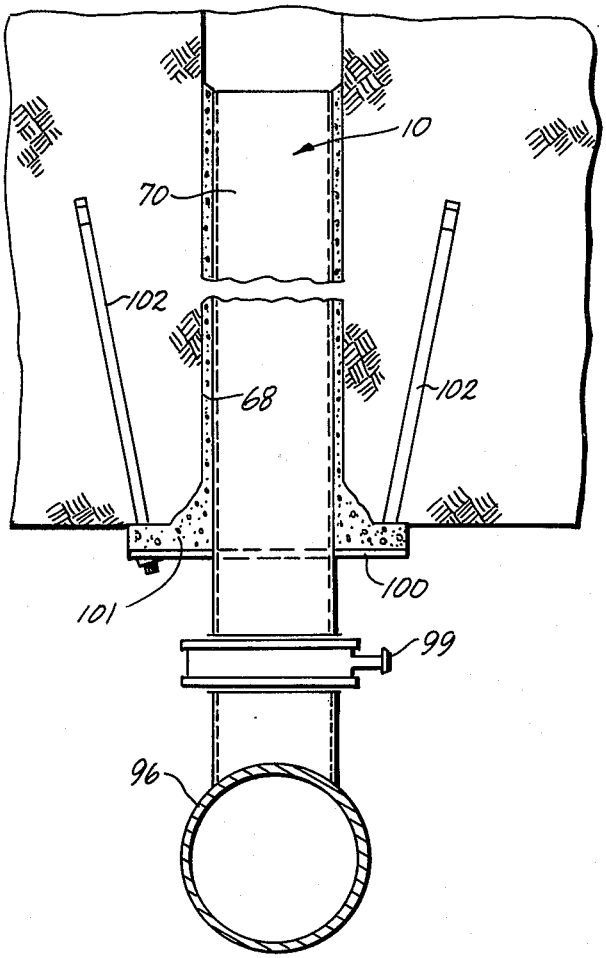
FIG. 6 is a fragmentary elevation view, partly in vertical cross-section, showing an enlarged view of a gas outlet within the circle 6 of FIG. 3.

Referring to FIG. 6, the lower casings 70 in each of the gas outlet holes have corresponding valves for use in controlling the amount of gas flowing through each gas outlet line. The lower portion of each lower casing projects downwardly into the production level void below the roof of the void, and a separate butterfly valve 99 is connected to the projecting portion of each lower casing. On the outlet side of each valve, a separate portion of the gas withdrawal manifold (described above) conducts off gas away from each valve. The portion of each lower casing 70 above the valve is sealed to formation above the production level void. An annular flange 100 on the projecting portion of each lower casing underlies grout 101 which seals the casing to adjacent formation, and each flange is secured to adjacent formation by a number of rock bolts 102.

Figure 7:
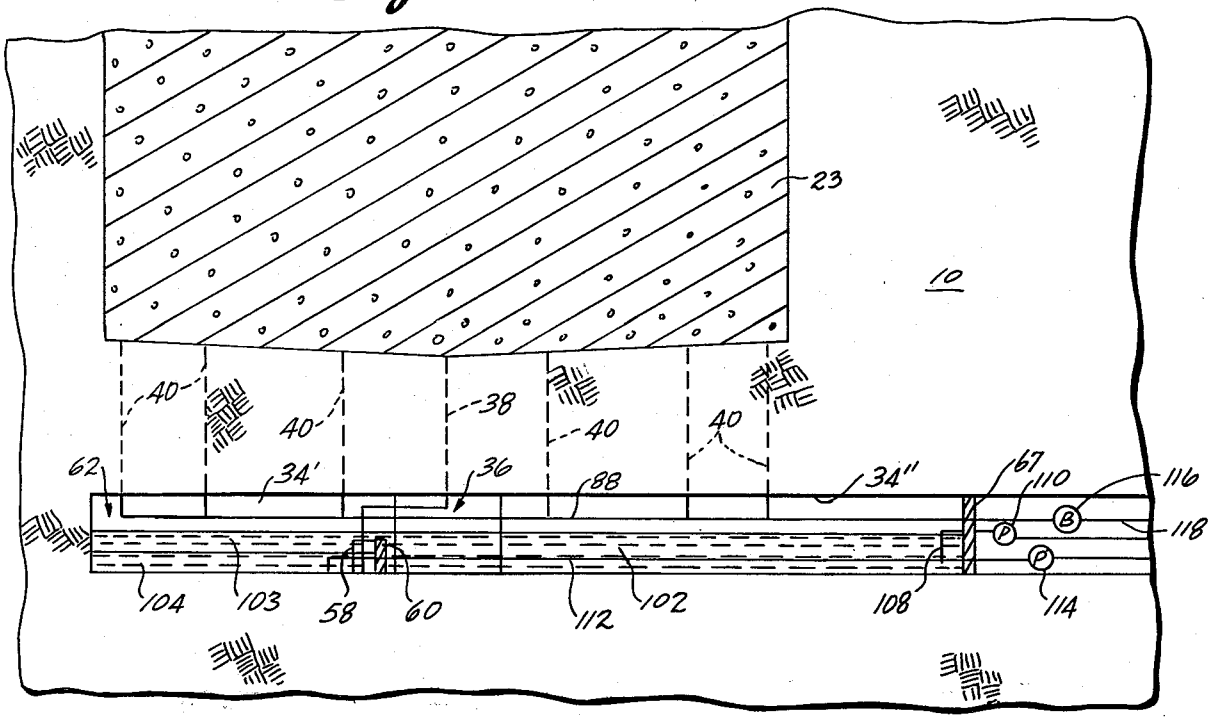
FIG. 7 is a fragmentary, semi-schematic vertical cross-section showing means for withdrawing liquid and gaseous products from a production level drift below a completed in situ oil shale retort.

FIG. 7 schematically illustrates a completed in situ retort in which shale oil and off gas are recovered from the fragmented mass 23. The sump 62 in the main stub drift portion 34' of the production level void collects liquid products, namely, shale oil 103 and water 104, that drain into the sump from the liquid outlet line 38. The main bulkhead 67 extends across the entire horizontal cross-section of the main production level drift and provides a dam for shale oil overflowing the sump bulkhead 60. A shale oil withdrawal line 108 extends from near the bottom inside portion of the main bulkhead 67 out through a sealed opening in the bulkhead, and the shale oil withdrawal line is connected to an oil pump 110 for withdrawing shale oil from the production level void separately from water and off gas. A separate shale oil withdrawal line (not shown) can extend beyond the sump bulkhead 60 for withdrawing shale oil from behind that bulkhead, if desired. Separately, a water withdrawal line 112 extends from near the bottom of the sump 62 inside the sump bulkhead 60 and is connected to a water pump 114 for withdrawing water from the production level void separately from the oil and off gas. The oil and water pumps can be operated manually or by automatic controls. The inlet of a blower 116 is connected to an outlet portion of the off gas withdrawal manifold 88 for withdrawing off gas from the production level drift separately from the shale oil and the water. The blower can produce negative pressure for drawing off gas downwardly through the fragmented mass and through the gas outlet lines to the gas withdrawal manifold. The outlet of the blower delivers off gas from the retort through a conduit 118 leading to a recovery or disposal system (not shown).

The valves 99 installed between the gas outlet lines and the manifold permit control of the gas flow pattern through the fragmented mass. Instrumentation (not shown) can be provided in each gas withdrawal conduit for measuring flow of off gas through each conduit. The gas outlet lines shown in the illustrated embodiment are distributed across the horizontal cross-section of the fragmented mass so that gas flow across the entire horizontal cross-section of the fragmented mass can be controlled by selectively adjusting the flow rate of gas flowing through each of the gas outlet lines. Each valve can be manually adjusted from locations within the production level drift, using monitored gas flow rate data, for producing a generally uniform flow of gas across the horizontal cross-section of the retort.

The liquid outlet line and the caps on the gas outlet lines cooperate to separate liquid products from gaseous products within the fragmented mass, allowing liquid and gaseous products to be conducted separately from one another from the lower portion of the fragmented mass to the production level void below the fragmented mass. Since the gaseous products recovered from the fragmented mass are sealed by the lower sill pillar, by the gas seal in the drainage tank in the production level void, and by the gas outlet lines and the manifold, there is no need for a pressurized bulkhead in the production level. The bulkheads shown in the production level can be generally thin, non-structural bulkheads sufficient to provide a liquid sump wall. The main bulkhead 67 need not be gas-tight, but can be sufficient to inhibit minor amounts of hydrocarbon vapors over the shale oil in the sump from entering adjacent underground workings.

What is claimed is:

1. A method for recovering liquid and gaseous products from an in situ oil shale retort formed within a retort site in a subterranean formation containing oil shale, such an in situ oil shale retort containing a fragmented permeable mass of formation particles containing oil shale within upper, lower and side boundaries of the retort site, comprising the steps of:

excavating at least one retort level void in formation within a lower portion of the retort site;

excavating a production level void in formation spaced below the lower boundary of the retort site, leaving a zone of unfragmented formation between the lower boundary of the retort site and the production level void;

providing at least one liquid outlet line extending from the retort level void through said zone of unfragmented formation into the production level void;

providing at least one gas outlet line extending from the retort level void through said zone of unfragmented formation into the production level void separate from the liquid outlet line;

placing explosive in a remaining portion of unfragmented formation with the retort site adjacent the retort level void;

detonating such explosive for explosively expanding such remaining portion of formation toward at least the retort level void for forming a fragmented permeable mass of formation particles containing oil shale within the upper, lower, and side boundaries of the retort site, such a gas outlet line and such a liquid outlet line communicating with a lower portion of the fragmented mass;

establishing a retorting zone in an upper portion of the fragmented mass and advancing the retorting zone through the fragmented mass for producing liquid and gaseous products of retorting;

withdrawing such liquid products from the fragmented mass through such a liquid outlet line; and separately withdrawing such gaseous products from the fragmented mass through such a gas outlet line.

2. The method according to claim 1 in which the retort level void extends across a horizontal cross-section of the fragmented mass being formed; and including providing a plurality of such gas outlet lines distributed across a horizontal cross-section of the retort level void for withdrawing gaseous products from separate locations spaced apart across the horizontal cross-section of the fragmented mass.

3. The method according to claim 2 including independently controlling the flow of gaseous products through the gas outlet lines for providing a generally uniform flow of gas across the horizontal cross-section of the fragmented mass.

4. The method according to claim 2 including conducting gaseous products from the fragmented mass through a plurality of such gas outlet lines into a gas withdrawal manifold in the production level void; and withdrawing gaseous products from the production level void through the manifold.

5. The method according to claim 1 including drawing liquid products into such a liquid outlet line from a lower elevation within the fragmented mass than the elevation from which gaseous products are drawn into such a gas outlet line from the fragmented mass.

6. The method according to claim 1 including separating liquid products from gaseous products within the fragmented mass prior to the liquid and gaseous products flowing into such liquid and gas outlet lines.

7. Apparatus for recovering liquid and gaseous products from an in situ oil shale retort formed within a retort site in a subterranean formation containing oil shale, the apparatus comprising:

a fragmented permeable mass of formation particles containing oil shale formed within the retort site, wherein a retorting zone is established in an upper portion of the fragmented mass and advanced through the fragmented mass for producing liquid and gaseous products of retorting;

a production level void spaced below the fragmented mass;

a zone of unfragmented formation between a lower portion of the fragmented mass and the production level void;

at least one liquid outlet line extending from a lower portion of the fragmented mass through said zone of unfragmented formation and into the production level void for conducting liquid products to the production level void;

at least one gas outlet line extending from a lower portion of the fragmented mass through said zone of unfragmented formation and into the production level void for conducting gaseous products to the production level void separate from the liquid products;

means for withdrawing from the production level void liquid products conducted thereto by such a liquid outlet line; and means for withdrawing from the production level void gaseous products conducted thereto by such a gas outlet line.

8. Apparatus according to claim 7 including liquid/gas separation means within the fragmented mass for directing flow of liquid products into an inlet of such a liquid outlet line within the fragmented mass and for directing flow of gaseous products into an inlet of such a gas outlet line within the fragmented mass and for inhibiting flow of liquid products into said inlet of such a gas outlet line.

9. Apparatus according to claim 8 including gas seal means for inhibiting flow of gas from the fragmented mass through such a liquid outlet line.

10. Apparatus according to claim 7 in which such a gas outlet line has a gas inlet in a lower portion of the fragmented mass; and including liquid/gas separation means adjacent such a gas inlet for causing a change in direction of flow within the separation means prior to entry of gas into such a gas inlet.

11. Apparatus according to claim 10 in which such a liquid/gas separation means includes a cap spaced from the gas inlet to such gas outlet line, the cap providing a chamber through which gas flows from the fragmented mass prior to entering the gas inlet of the gas outlet line; and in which the cap has a second gas inlet through which gas from the fragmented mass flows prior to entry into said chamber; the second gas inlet being at a lower elevation than the elevation of the gas inlet to the gas outlet line for producing said change in direction of flow within the separation means.

12. Apparatus according to claim 10 including a plurality of such gas outlet lines having gas inlets distributed across a horizontal cross-section of the fragmented mass; and in which each gas outlet line has a corresponding one of said liquid/gas separation means.

13. Apparatus according to claim 12 including a gas withdrawal manifold in the production level void; and in which said plurality of gas outlet lines are connected to the gas withdrawal manifold in the production level void; and including means for withdrawing gas from the gas withdrawal manifold.

14. Apparatus according to claim 13 including separate valve means one each gas outlet line in the production level void for independently controlling flow of gas from the fragmented mass through each gas outlet line to the manifold.

15. Apparatus according to claim 7 in which the lower boundary of the fragmented mass comprises a floor which slopes downwardly toward an inlet of the liquid outlet line for enabling liquid products to drain into the inlet to such a liquid outlet line; and in which the inlet to the liquid outlet line is at a lower elevation on the floor than a gas inlet to such a gas outlet line.

16. Apparatus according to claim 15 including a plurality of such gas outlet lines having gas inlets distributed across a horizontal cross-section of the fragmented mass, such gas inlets being above the elevation of the inlet to such a liquid outlet line; and each of such gas outlet lines including a separate liquid/gas separation means adjacent the inlet to such gas outlet line for inhibiting flow of liquid products from the fragmented mass into the inlet of such a gas outlet line.

17. Apparatus according to claim 16 including a gas withdrawal manifold in the production level void; and in which said plurality of gas outlet lines are connected to the gas withdrawal manifold in the production level void; and including means for withdrawing gas from the gas withdrawal manifold.

18. Apparatus according to claim 16 including separate valve means on each gas outlet line in the production level void for independently adjusting the flow of gas through each gas outlet line from locations within the production level void.

19. Apparatus according to claim 7 in which said gas outlet lines are arranged such that approximately equal amounts of said fragmented mass are located above each such gas outlet line.

20. In an in situ oil shale retort formed within a retort site in a subterranean formation containing oil shale, such an in situ retort containing a fragmented permeable mass of formation particles containing oil shale, wherein a retorting zone established in an upper portion of the fragmented mass and advanced through the fragmented mass produces liquid and gaseous products of retorting, and further including a production level void spaced below a lower boundary of the fragmented mass, and means within the production level void for withdrawing liquid products conducted from the fragmented mass to the production level void, the improvement comprising:

a gas barrier of unfragmented formation between the lower boundary of the fragmented mass and the production level void;

a plurality of gas outlet means distributed across a horizontal cross section of the fragmented mass for conducting all of the gaseous products from distributed portions of the fragmented mass through the gas barrier to the production level void;

gas withdrawal means communicating with the gas outlet means in the production level void for withdrawing from the production level void the gaseous products conducted thereto by the gas outlet means; and means for withdrawing liquid products from the production level void separately from the gaseous products.

21. The improvement according to claim 20 including means sealing the gas outlet means to unfragmented formation within the gas barrier.

22. The improvement according to claim 21 in which the gas withdrawal means includes a gas withdrawal manifold communicating with such gas outlet means within the production level void; and means for withdrawing gaseous products from the manifold.

23. In an in situ oil shale retort formed within a retort site in a subterranean formation containing oil shale, such an in situ retort containing a fragmented permeable mass of formation particles containing oil shale, wherein a retorting zone established in an upper portion of the fragmented mass and advanced through the fragmented mass produces liquid and gaseous products of retorting, and further including a production level void spaced below a lower boundary of the fragmented mass, and means within the production level void of withdrawing liquid products conducted from the fragmented mass to the production level void, the improvement comprising:

a gas barrier of unfragmented formation between the lower boundary of the fragmented mass and the production level void;

a plurality of gas outlet means distributed across a horizontal cross section of the fragmented mass and sealed to unfragmented formation within the gas barrier for conducting gaseous products from the fragmented mass through the gas barrier to the production level void;

a gas withdrawal manifold communicating with such gas outlet means within the production level void;

means for withdrawing gaseous products from the manifold for withdrawing from the production level void gaseous products conducted thereto by the gas outlet means; and separate valve means in the production level void between each gas outlet means and the manifold for use in independently controlling flow of gas from the fragmented mass through the separate gas outlet means.

24. In an in situ oil shale retort formed within a retort site in a subterranean formation containing oil shale, such an in situ retort containing a fragmented permeable mass of formation particles containing oil shale, wherein a retorting zone established in an upper portion of the fragmented mass and advanced through the fragmented mass produces liquid and gaseous products of retorting, and further including a production level void spaced below a lower boundary of the fragmented mass, and means within the production level void for withdrawing liquid products conducted from the fragmented mass to the production level void, the improvement comprising:

a gas barrier of unfragmented formation between the lower boundary of the fragmented mass and the production level void;

a plurality of gas outlet means distributed across a horizontal cross section of the fragmented mass for conducting gaseous products from the fragmented mass through the gas barrier to the production level void;

liquid/gas separation means communicating with the gas outlet means in the fragmented mass for directing flow of gaseous products into the gas outlet means and for inhibiting flow of liquid products into the gas outlet means; and gas withdrawal means communicating with the gas outlet means in the production level void for withdrawing from the production level void gaseous products conducted thereto by the gas outlet means.

25. The improvement according to claim 24 in which each liquid/gas separation means includes a cap spaced from such gas outlet means, the cap providing a chamber through which gas flows from the fragmented mass prior to entering the gas outlet means; and in which the cap has a gas inlet through which gas from the fragmented mass flows prior to entry into the chamber; the gas inlet being at a lower elevation than the elevation of the gas outlet means.

26. The improvement according to claim 20 including means in the production level void for adjusting the flow rate of gas through such gas outlet means from a location within the production level void.

27. The improvement according to claim 26 in which approximately equal amounts of the fragmented mass are located above each of such gas outlet means.

28. In an in situ oil shale retort formed within a retort site in a subterranean formation containing oil shale, such an in situ retort containing a fragmented permeable mass of formation particles containing oil shale, wherein a retorting zone established in an upper portion of the fragmented mass and advanced downwardly through the fragmented mass produces liquid and gaseous products of retorting; and further including a production level void spaced below a lower boundary of the fragmented mass, and means within the production level void for withdrawing liquid products conducted from the fragmented mass to the production level void, the improvement comprising:

a gas barrier of unfragmented formation between the lower boundary of the fragmented mass and the production level void;

gas outlet means communicating with a lower portion of the fragmented mass and extending through said gas barrier into the production level void;

gas withdrawal means communicating with the gas outlet means for withdrawing from the production level void gaseous products conducted thereto through the gas outlet means; and liquid/gas separation means in the fragmented mass adjacent an inlet to such gas outlet means for inhibiting flow of liquid products from the fragmented mass into the inlet of such gas outlet means and for permitting gas to flow from the fragmented mass into the inlet of such gas outlet means.

29. The improvement according to claim 28 including means sealing such a gas outlet means to unfragmented formation within said gas barrier.

30. The improvement according to claim 28 in which the liquid/gas separation means includes a cap adjacent the inlet to such gas outlet means providing a chamber through which gas flows from the fragmented mass prior to entering said inlet; and in which the cap has a second gas inlet through which gas from the fragmented mass flows prior to entering said chamber; the second gas inlet being at a lower elevation than the elevation of the inlet to such gas outlet means.

31. The improvement according to claim 30 in which such a gas outlet means includes a conduit projecting into the fragmented mass, and means sealing said conduit to adjacent unfragmented formation of the gas barrier; and in which said cap is secured to said conduit.

32. The improvement according to claim 29 in which the liquid/gas separation means has an interior portion within the fragmented mass adjacent the inlet to such gas outlet means for causing gas flowing from the fragmented mass to flow through a change in direction within said interior portion prior to entering the inlet to such gas outlet means.

33. Apparatus for recovering liquid and gaseous products from an in situ oil shale retort formed within a retort site in a subterranean formation containing oil shale, such an in situ oil shale retort comprising a fragmented permeable mass of formation particles containing oil shale, wherein a retorting zone established within the fragmented mass and advanced through the fragmented mass produces liquid and gaseous products of retorting, the apparatus comprising:

a production level void spaced below a lower boundary of the fragmented mass;

a zone of unfragmented formation providing a gas barrier between the lower boundary of the fragmented mass and the production level void, the zone of unfragmented formation forming a floor adjacent a lower portion of the fragmented mass, the floor being sloped downwardly to at least one region of lower elevation than an adjacent region of the floor so that liquid products of retorting can flow across the floor toward said region of lower elevation;

at least one liquid outlet line having an inlet at such a region of lower elevation, such liquid outlet line extending through the zone of unfragmented formation into the production level void;

a sump in the production level void communicating with the liquid outlet line for containing liquid products withdrawn from the fragmented mass through the liquid outlet line;

gas outlet means in a lower portion of the fragmented mass and extending through the zone of unfragmented formation into the production level void, the inlet to such gas outlet means being at a higher elevation in the fragmented mass than said region of lower elevation;

gas withdrawal means communicating with the gas outlet means in the production level void for withdrawing from the production void gaseous products conducted thereto through the gas outlet means; and liquid/gas separation means within the fragmented mass for inhibiting flow of liquid products from the fragmented mass into the gas outlet means and for permitting gaseous products to flow from the fragmented mass into the gas outlet means.

34. Apparatus according to claim 33 in which the separation means includes means for causing gas flowing from the fragmented mass to undergo a change in direction within the fragmented mass before entering the gas outlet means.

35. Apparatus according to claim 33 including means for sealing such a liquid outlet line against passage of gas from the fragmented mass to the production level void.

36. Apparatus according to claim 33 in which the liquid/gas separation means includes a cap forming a chamber adjacent the gas inlet, and including means for causing gas to flow from the fragmented mass into said chamber prior to entering the gas inlet, and means for causing such gas to flow into said chamber at a lower elevation than the elevation at which gas flows into the gas inlet.

37. Apparatus according to claim 36 including means sealing such a gas outlet means to unfragmented formation within said gas barrier.

38. In an in situ oil shale retort formed within a retort site in formation containing oil shale, such an in situ oil shale retort containing a fragmented permeable mass of formation particles containing oil shale, wherein a retorting zone established within the fragmented mass and advanced downwardly through the fragmented mass produces liquid and gaseous products of retorting; and further including a production level void spaced below a lower boundary of the fragmented mass, a zone of unfragmented formation being between the production level void and the lower boundary of the fragmented mass, and means within the production level void for withdrawing liquid products conducted thereto from the fragmented mass, the improvement comprising:

a plurality of separate gas outlet means distributed across a horizontal cross-section of a lower portion of the fragmented mass and extending downwardly through the zone of unfragmented formation into the production level void;

separate valve means within the production level void for separately controlling flow of gas through each of the gas outlet means;

means communicating with the gas outlet means in the production level void for withdrawing from the production level void gaseous products conducted thereto through the gas outlet means; and means for separating liquid from gas within the fragmented mass prior to entry of separated gas into such gas outlet means.

39. The improvement according to claim 40 including a gas withdrawal manifold within the production level void communicating with the gas outlet means and means communicating with the gas withdrawal manifold means for withdrawing gas from the gas withdrawal manifold.

40. A method for recovering liquid and gaseous products from an in situ oil shale retort formed within a retort site in a subterranean formation containing oil shale, such an in situ oil shale retort containing a fragmented permeable mass of formation particles containing oil shale, wherein a retorting zone established in an upper portion of the fragmented mass and advanced downwardly through the fragmented mass produces liquid and gaseous products of retorting, the method comprising the steps of:

providing a production level void at a level spaced below a lower boundary of the fragmented mass, leaving a zone of unfragmented formation between the production level void and the lower boundary of the fragmented mass;

conducting liquid products of retorting downwardly to the production level void;

providing a plurality of mutually spaced apart gas outlet means across a horizontal cross-section of a lower portion of the fragmented mass;

conducting gaseous products from the spaced apart gas outlet means through separate gas outlet lines extending downwardly through the zone of unfragmented formation into the production level void;

separately controlling the flow of gas through each gas outlet line from locations within the production level void for selectively withdrawing gas from the gas outlet lines for balancing the flow of gas from the top to the bottom of the fragmented mass; and separating liquid from gas within the fragmented mass prior to such gas flowing through such gas outlet lines.

41. An in situ oil shale retort formed within a retort site having side boundaries of unfragmented formation in a subterranean formation containing oil shale comprising:

a fragmented permeable mass of formation particles containing oil shale within the retort;

a production level drift spaced below the fragmented mass;

a lower zone of unfragmented formation between a lower portion of the fragmented mass and the production level drift;

a central vertically extending product withdrawal passage through the lower zone of unfragmented formation in the center of the retort site;

a plurality of additional vertically extending product withdrawal passages through the lower zone of unfragmented formation, each of the additional product withdrawal passages being between the central product withdrawal passage and the middle of a side boundary of the retort site; and means at the top of each such product withdrawal passage for inhibiting particles from the fragmented mass from entering such product withdrawal passage.

42. An in situ retort according to claim 41 further comprising means in the production level drift connected to the central product withdrawal passage for withdrawing liquid products of retorting and means in the production level drift connected to each of the additional product withdrawal passages for withdrawing gaseous products of retorting.

43. An in situ oil shale retort as recited in claim 41 wherein the means for inhibiting particles from entering each such additional product withdrawal passage comprises means for permitting flow of gaseous products of retorting and inhibiting flow of liquid products of retorting into such product withdrawal passage.

44. An in situ oil shale retort formed within a retort site having side boundaries of unfragmented formation in a subterranean formation containing oil shale, comprising:

a fragmented permeable mass of formation particles containing oil shale within the retort, the fragmented mass being substantially square in horizontal cross section;

a production level drift spaced below the fragmented mass;

a lower zone of unfragmented formation between a lower portion of the fragmented mass and the production level drift;

at least five product withdrawal passages mutually spaced apart in a cross-shaped pattern across the lower portion of the fragmented mass in the retort, each of such product withdrawal passages extending from the bottom of the fragmented mass through the lower zone of unfragmented formation to the production level drift for conducting products of retorting from the fragmented mass to the production level drift, one of the product withdrawal passages being in the center of the horizontal cross section of the retort, each of the other product withdrawal passages being between the center passage and the middle of one of the side boundaries;

means at the top of each of such product withdrawal passages for inhibiting particles from the fragmented mass from entering such product withdrawal passage; and means for withdrawing products of retorting from the production level drift.

45. An in situ retort according to claim 44 wherein each of the product withdrawal passages extends vertically through the lower zone of unfragmented formation.

46. An in situ retort according to claim 44 wherein the means for withdrawing products of retorting comprises means in the production level drift connected to the center product withdrawal passage for withdrawing liquid products of retorting and means in the production level drift connected to each of the other product withdrawal passages for withdrawing gaseous products of retorting.

* * * * *

UNITED STATES PATENT AND TRADEMARK OFFICE

CERTIFICATE OF CORRECTION

PATENT NO. : 4,357,051

DATED : November 2, 1982

INVENTOR(S) : Martin M. Siegel

It is certified that error appears in the above-identified patent and that said Letters Patent is hereby corrected as shown below:

Column 19, line 35, "40" should be -- 38 --.

Signed and Sealed this

*Eighth* Day of *February 1983*

[SEAL]

*Attest:*

GERALD J. MOSSINGHOFF

*Attesting Officer*

*Commissioner of Patents and Trademarks*

UNITED STATES PATENT AND TRADEMARK OFFICE

CERTIFICATE OF CORRECTION

PATENT NO. : 4,357,051

DATED : November 2, 1982

INVENTOR(S) : Martin M. Siegel

It is certified that error appears in the above—identified patent and that said Letters Patent is hereby corrected as shown below:

Please add the following language as the first paragraph under the heading "Background of the Invention".

--The Government has rights in this invention pursuant to Contract No. DE-FC20-78-LC10036 (formerly EF-77-A-04-3873) awarded by the U.S. Department of Energy.--

Signed and Sealed this

Ninth Day of August 1983

[SEAL]

*Attest:*

GERALD J. MOSSINGHOFF

*Attesting Officer*

*Commissioner of Patents and Trademarks*